US008147357B1

(12) United States Patent
Nichols

(10) Patent No.: US 8,147,357 B1
(45) Date of Patent: Apr. 3, 2012

(54) BASEBALL SWING TRAINER DEVICE AND METHOD

(76) Inventor: Gary S. Nichols, Richland, MS (US)

( * ) Notice: Subject to any disclaimer, the term of this patent is extended or adjusted under 35 U.S.C. 154(b) by 112 days.

(21) Appl. No.: 12/507,871

(22) Filed: Jul. 23, 2009

Related U.S. Application Data

(60) Provisional application No. 61/082,893, filed on Jul. 23, 2008.

(51) Int. Cl.
*A63B 69/00* (2006.01)

(52) U.S. Cl. ..... 473/453

(58) Field of Classification Search ..... 473/451–453, 473/457, 422, 229
See application file for complete search history.

(56) References Cited

U.S. PATENT DOCUMENTS

| | | | | |
|---|---|---|---|---|
| 1,567,530 | A * | 12/1925 | MacNaughton et al. | 473/229 |
| 3,711,103 | A * | 1/1973 | Seltzer | 473/229 |
| 3,940,131 | A | 2/1976 | St. Claire, Jr. | |
| 4,451,036 | A | 5/1984 | Sinclair et al. | |
| 4,516,771 | A | 5/1985 | Nau | |
| 2,985,452 | A | 5/1991 | Trippet | |
| 5,029,852 | A | 7/1991 | Gilfillan | |
| 5,087,039 | A | 2/1992 | Laseke | |
| 5,156,402 | A | 10/1992 | Hart | |
| 5,322,276 | A | 6/1994 | Hardison, Jr. | |
| 5,595,384 | A | 1/1997 | Hardison, Jr. | |
| 5,895,327 | A * | 4/1999 | Francisco | 473/229 |
| 5,954,598 | A | 9/1999 | Carlson | |
| 6,435,990 | B1 | 8/2002 | Bradley | |
| 6,461,255 | B1 | 10/2002 | Smith | |
| 6,537,184 | B2 * | 3/2003 | Kim | 482/122 |
| 6,666,781 | B1 * | 12/2003 | Illis | 473/453 |
| 6,830,521 | B2 | 12/2004 | Socci | |
| 7,033,290 | B1 * | 4/2006 | Coldren | 473/453 |
| 7,056,224 | B1 * | 6/2006 | Keyes | 473/257 |
| 7,128,658 | B2 | 10/2006 | DuFour | |
| 7,131,916 | B2 | 11/2006 | Griffin | |
| 7,517,290 | B1 * | 4/2009 | Springer | 473/422 |
| 2004/0087390 | A1 * | 5/2004 | Mauer et al. | 473/417 |
| 2004/0229736 | A1 | 11/2004 | Dise et al. | |
| 2006/0089212 | A1 | 4/2006 | Marchel | |
| 2006/0135292 | A1 * | 6/2006 | Griffin | 473/453 |

* cited by examiner

*Primary Examiner* — Mark Graham
(74) *Attorney, Agent, or Firm* — McGarry Bair PC

(57) ABSTRACT

A swing training device comprises a swing guide, a mount adapted to position the swing guide at a height above the ground selected by a user and a swing implement comprising a handle portion for gripping by a user. The first channel has a rearward end cooperating with a rearward end of the second channel, the second channel positioned angularly with respect to the first channel. The first and second channels also have a lateral opening extending generally along their length. The swing implement includes a connector portion mounted to the swing implement generally adjacent to the handle portion and has a distal end thereon.

14 Claims, 14 Drawing Sheets

BASEBALL SWING TRAINER DEVICE AND METHOD

CROSS-REFERENCE TO RELATED APPLICATIONS

This application claims the benefit of U.S. Provisional Patent Application No. 61/082,893, filed Jul. 23, 2008, which is incorporated herein by reference in its entirety.

BACKGROUND OF THE INVENTION

1. Field of the Invention

The invention generally relates to baseball training devices, and, more specifically, to a training device for perfecting the baseball swing of the batter.

2. Description of the Related Art

As is well known, baseball is a sport widely played in the United States, Canada, Japan and many parts of South America, in which a series of batters attempt, in turn, to swing a bat and make contact with a baseball thrown by a "pitcher" from the opposing team. The baseball is typically thrown by the pitcher, at least in the Major Leagues, from a pitcher's mound located a distance of sixty feet, six inches from home plate where the batter stands. This distance is shorter for younger players.

Common mistakes made by batters include: loading with the upper body (by rotating the shoulders instead of just taking the hands back), barring with the lead arm which does not allow the hands to take the proper path down to the ball, and casting of the bat head which causes the batter to roll the top hand over too soon.

There have been many attempts to provide training devices that aid players in improving their swing. Many training devices previously known in the field are difficult to use, often too heavy and complex to be used efficiently. The devices disclosed in U.S. Pat. No. 5,156,402 and U.S. Pat. No. 7,131,916, for example, comprise large structures with a suspension arm extending over the head of the batter. U.S. Pat. No. 5,156,402 suspends a ball from the over-head arm for a batter to swing at; U.S. Pat. No. 7,131,916 provides a drive-arm with a baseball bat that offers resistance to the batter during a swing. These devices are large and have numerous moving parts, making them difficult to store and maintain. In addition, neither device trains the batter in using appropriate technique.

Another type of training device found in the prior art are those that require a player to swing at a target area, potentially causing injury to the player or damage to the device with inadvertent swings. For example, U.S. Pat. No. 3,940,131, U.S. Pat. No. 5,087,039 and U.S. Pat. No. 6,435,990 disclose devices comprising two parallel bars between which a ball is placed. The goal of these devices is to train the batter to keep the bat level during a swing. If the bat is kept level and at the right height, the bat will travel between the bars and hit the ball. However, swings that are not level or at the wrong height will result in the batter striking the training device, potentially causing injury or damage. In addition, these devices allow the batter to take inappropriate steps during the course of the swing, such as loading with the upper body, barring with the lead arm and casting the bat head.

Yet another type of training device found in the prior art pertains to devices that do not provide a realistic batting experience because they limit or guide the swing only during select steps that occur in the course of a full baseball swing. For example, U.S. Pat. No. 6,641,255 discloses a tube into which a bat is inserted at the beginning of a swing. The tube is positioned behind the batter and the bat is inserted to position the bat to start the swing. The bat is pulled out of the tube as the batter swings the bat. This device only shows the batter the correct height for a bat at the start of a swing; it does not train the batter to start a swing using appropriate form and it does not offer any training or feedback throughout the course of the swing. Other devices, such as those disclosed in U.S. Pat. No. 5,029,852 and U.S. Pat. No. 5,595,384 provide a curved bar that the batter slides a bat along during the course of a swing. These devices guide the course of the bat during a swing, but still allow the batter to take inappropriate steps during the course of the swing, such as loading with the upper body, barring with the lead arm and casting the bat head.

SUMMARY OF THE INVENTION

According to one embodiment of the invention, a swing training device comprises a swing guide having first and second channels therein, each of the first and second channels having a rearward end, the second channel positioned in a downward and forward angular position with respect to the first channel, and an acute angle portion, wherein the acute angle portion interconnects the rearward end of the first channel with the rearward of the second channel, the first and second channels having a lateral opening extendinggenerally along their length, a mount adapted to position the swing guide at a height above the ground selected by a user and a swing implement comprising a first end, a second end, a handle portion therebetween for gripping by a user, and a connector portion adapted to be received in the channels, whereby the user's hand is positioned on the handle portion adjacent the first end of the swing implement. The connector portion has a distal end thereon, which, when the swing implement is used with the swing guide, movement of the first end of the swing implement is restricted by apath defined by the movement of the distal end of the connector portion through the first channel, through the acute angle portion, and into the second channel to train the user in a proper swing motion.

According to another embodiment of the invention, the distal end of the connector portion is slidably mounted within at least one of the first and second channels with the connector portion extending through the lateral opening thereof, and movement of the swing implement is maintained along a desired swing path defined by the interconnection of the first and second channels.

According to yet another embodiment of the invention, the distal end of the connector portion has a tip generally corresponding in size to the size of at least one of the first and second channels, and a neck generally corresponding in size to the lateral opening in the first and second channels. The size of the tip on the distal end of the connector can be larger than the size of the neck. The connector portion further comprises a neck portion which extends through the lateral opening in the first and second channels when the distal end of the connector portion is positioned within the first and second channels, and wherein the connector portion can be provided with neck portions having different thicknesses to provide greater precision in swing training, whereby as the thickness of the neck portion of the connector portion approaches the thickness of the lateral opening of the first and second channels, the user must maintain the handle portion much closer to a desired swing path.

According to another embodiment of the invention, the first channel of the swing guide is positioned generally horizontally. The second channel can be positioned in a downward and forward angular position with the respect to the rearward end of the first channel.

According to yet another embodiment of the invention, the first channel corresponds to a locking portion of a desired swing path. The second channel can correspond to a release portion of a desired swing path.

According to another embodiment of the invention, the swing training device further comprises a target object positioned generally along a desired swing path past an exit point of the second channel, wherein a user would strike the target object by passing the swing implement along the desired swing path following a disconnection of the swing implement from the second channel.

According to another embodiment of the invention, a dimension of the lateral opening of the first and second channels is less than a dimension of the first and second channels.

According to yet another embodiment of the invention, the mount includes an adjustable portion for varying the height of the swing guide above the ground. The mount can include a vertically-adjustable telescoping arm for selectively positioning the swing guide above the ground. The mount can also include a stand mounted to a lower end of the telescoping arm.

According to another embodiment of the invention, a method for training a player to swing a bat along a desired swing path comprises the steps of positioning the player in an initial batting stance with a bat having a handle portion thereon and physically restricting the handle portion generally adjacent a knob end of the bat along a desired swing path from the initial batting stance to a loaded batting stance and from the loaded batting stance to impact with a target object.

According to yet another embodiment of the invention, the steps of physically restricting the handle portion generally adjacent the knob end of the bat further comprise connecting the handle portion of the bat to a directional channel representative of the desired swing path. The method can further comprise the step of adjustably positioning the height of the directional channel above the ground.

BRIEF DESCRIPTION OF THE DRAWINGS

In the drawings:

FIG. 11 is a schematic illustration of the starting position with a modified training bat positioned in the swing training device according to the invention.

FIG. 12 is a schematic illustration of the modified bat moved to the load position.

FIG. 13 is a schematic illustration of the modified bat moved to the ball position.

FIG. 14 is a schematic illustration of the modified bat moved near to the ball contact position.

FIG. 15 is a schematic illustration of the modified bat moved to the follow through and finish position.

DESCRIPTION OF THE PREFERRED EMBODIMENT

Figure 1A:
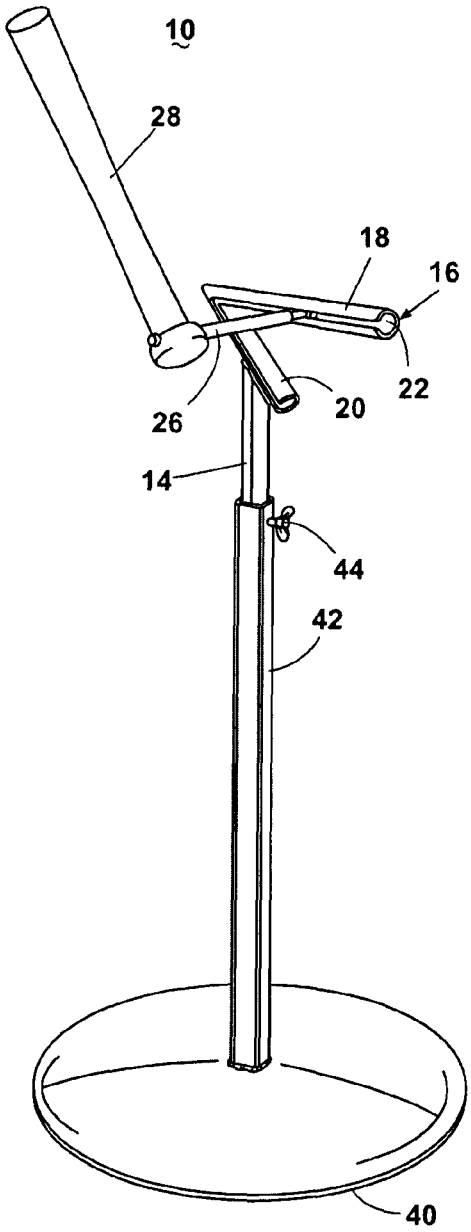
FIG. 1*a* is a schematic illustration of a baseball swing training device for a left-handed batter according to one embodiment of the invention.
Figure 1B:
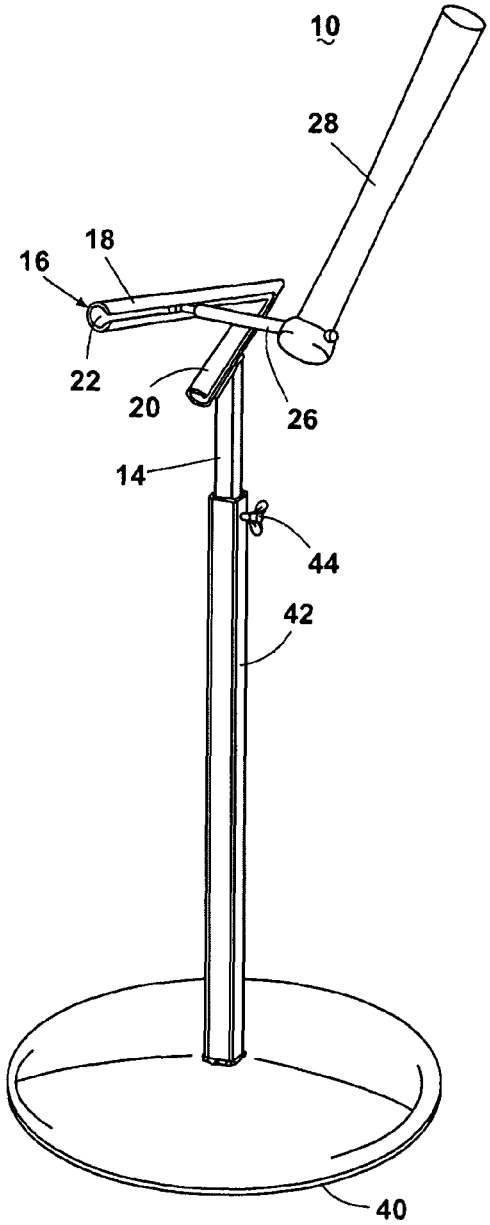
FIG. 1*b* is a schematic illustration of a baseball swing training device for a right-handed batter according to an embodiment of the invention.

FIGS. 1*a* and 1*b* illustrate an exemplary swing trainer 10 for a left-handed batter and a right-handed batter, respectively, according to one embodiment of the invention. Like numerals have been used to describe like parts. The swing trainer 10 comprises a vertical mounting post 14 for mounting a swing guide 16. The swing guide 16 comprises a first path member 18 and a second path member 20. The first path member 18 can generally be in the form of a C-shaped horizontal member having a first, open forward end that is coupled at a second, rearward end with the second path member 20. A rearward end of the second path member 20 can depend from the rearward end of the first member 18 at an angle in a generally forward direction. The second path member 20 can depend angularly from the rearward end of the first path member 18, preferably at an acute, forward-facing angle of 45 degrees, although it will be understood that other angles can be selected for the second path member 20 with respect to the first path member 18 without departing from the scope of this invention. While the first path member 18 and the second path member 20 are described in the context of a horizontal member and an angled member, respectively, it is within the scope of the invention for the first and second path members 18 and 20 to be provided at any suitable angle relative to one another.

A channel 22 is thereby defined by the cooperating and continuous interior portions of the C-shaped first path member 18 and the second path member 20 that extends longitudinally and continuously for slidably receiving one end of a connecting member 26. The connecting member 26 is preferably connected at another end to a swing implement 28. Of course, the swing implement 28 can be a full bat, the shape and configuration of which will be apparent to one skilled in the art, or a portion of the same, such as a sawed-off bat comprising only a conventional handle portion of a conventional bat. The swing implement 28 can also comprise a metal rod, such as a steel rod, in an interior portion of the swing implement 28 that can be coupled with the connecting member 26 to provide additional structural support to the swing implement 28.

The swing guide 16 for a right-handed batter as illustrated in FIG. 1*b* is a mirror image of the swing guide 16 for a left-handed batter as illustrated in FIG. 1*a*.

Figure 2A:
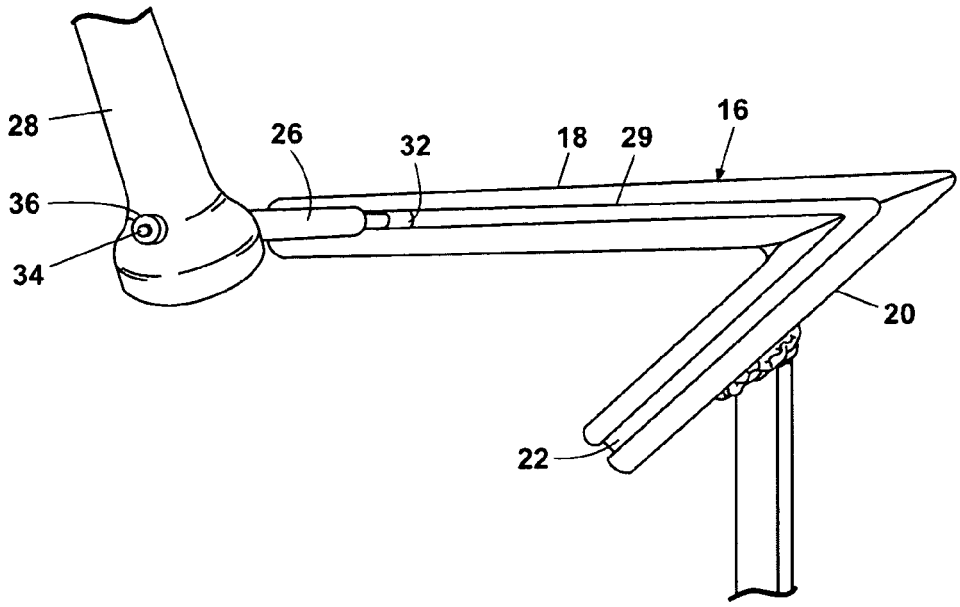
FIG. 2*a* is an exploded view of the baseball swing training device from FIG. 1*b*.
Figure 2B:
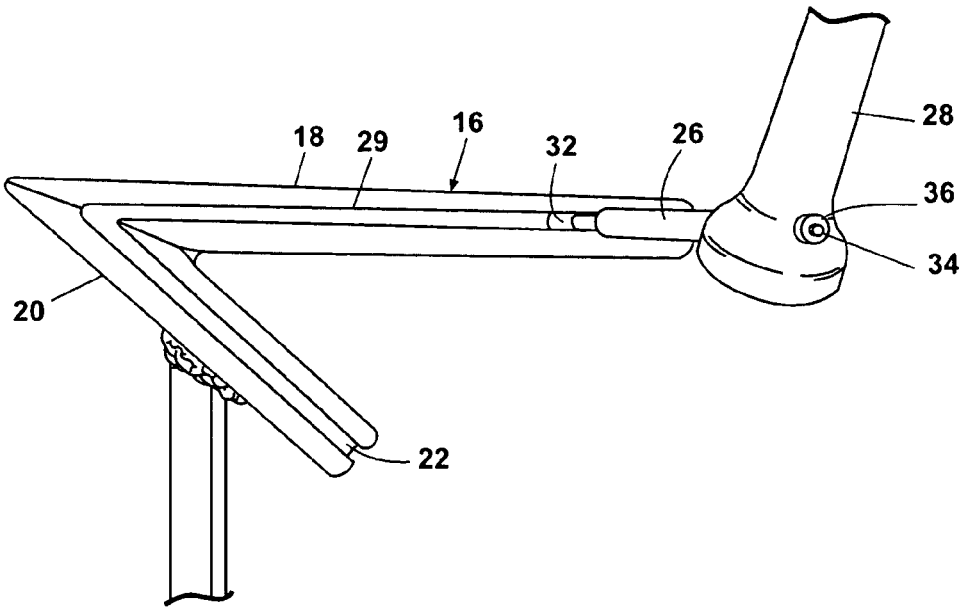
FIG. 2*b* is an exploded view of the baseball swing training device from FIG. 1*a*.

Referring now to FIGS. 2*a* and 2*b*, the swing guide 16 as illustrated in FIGS. 1*a* and 1*b* will be described in more detail. The first path member 18 is open at its first, forward end for receiving the connecting member 26 and connected to the second path member 20 at its second, rearward end. The second path member 20 extends in a generally downward and forward direction from the rearward end of first path member 18 at approximately a 45 degree angle relative to the first path member 18. A forward end of the second path member 20 is open to allow the connecting member 26 to exit the second path member 20. The second path member 20 depends from the first path member 18 such that the connecting member 26 may be fluidly guided along the entire length of the swing guide 16.

With continued reference to FIGS. 2*a* and 2*b*, the channel 22 preferably guides the movement of the swing implement 28 through its interconnection to the connecting member 26. The connecting member 26 has one end comprising a bearing 32 juxtaposed with an end of the swing implement 28. The bearing 32 is preferably sized to be received by and fluidly travel along the channel 22, if the swing implement 28 is moved in a path complementary with the channel 22, but will preferably bind in the channel 22 if the swing implement 28 is swung in an undesirable path, i.e., outside of the angles and path defined by the channel 22. The connecting member 26 has a reduced width portion or neck portion at one end to allow it to extend unimpeded through a slot 29 formed in the swing guide 16 which communicates with the channel 22 to facilitate the location of the bearing 32 within the channel 22. At an end opposite the bearing 32, the connecting member 26 comprises a threaded shaft 34 for connecting with the bottom of the swing implement 28 by means of a bolt 36 adjacent to a knob or distal end of the swing implement 28 opposite the end used to strike an object in the course of a swing. It will, of course, be understood that other methods and fasteners can be used to connect the connecting member 26 to the swing implement 28 without departing from the scope or spirit of the invention.

The bearing 32 can be integrally formed with the connecting member 26 or selectively coupled with the neck portion of the connecting member 26. For example, the neck portion of the connecting member 26 can include a threaded aperture for receiving a threaded shaft extending from the bearing 32. In this manner, the bearing 32 can be selectively uncoupled from the connecting member 26 for storage or for interchanging with other, additional components of the swing trainer 10.

Figure 3:
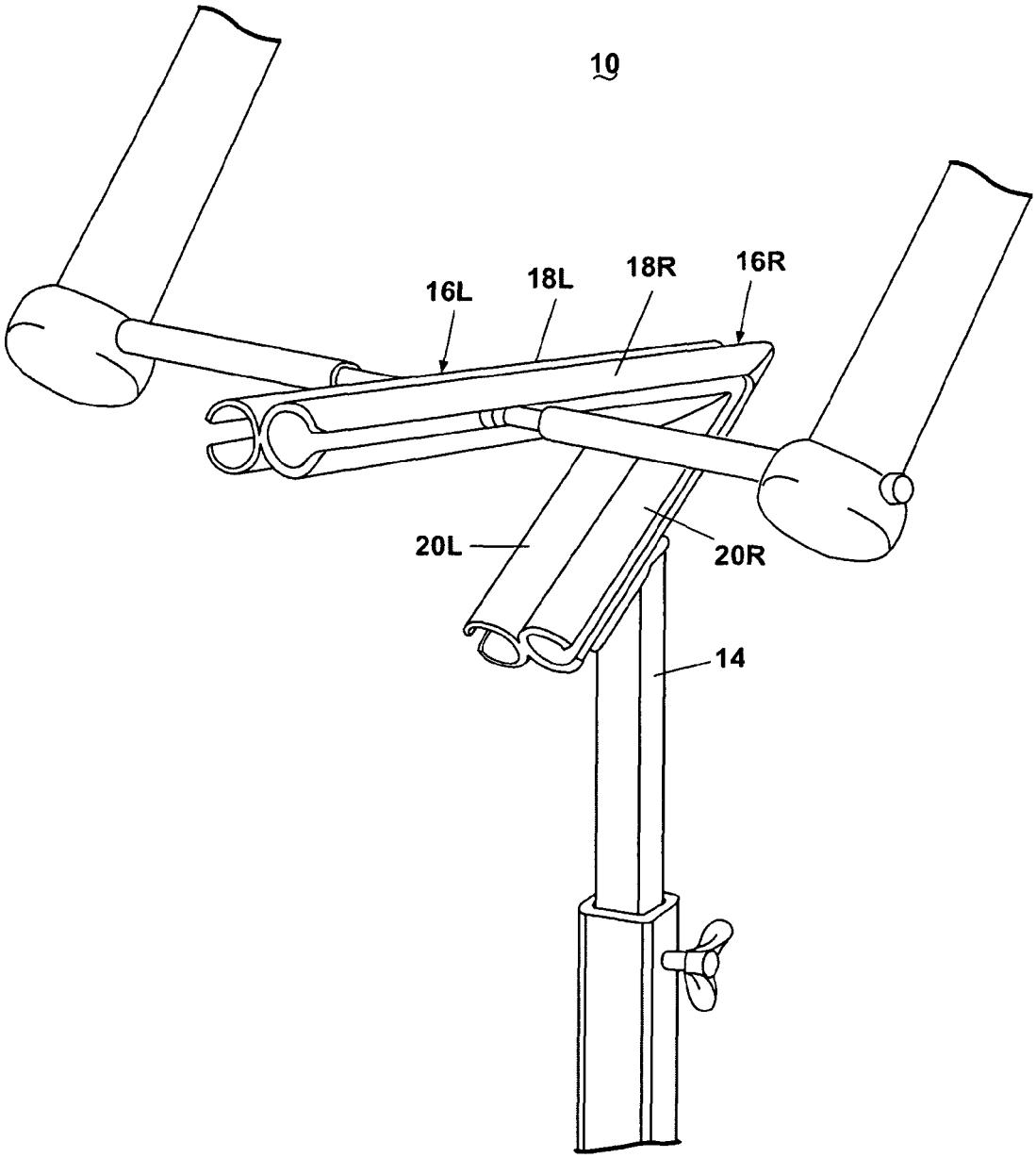
FIG. 3 is a schematic illustration of a baseball swing training device having portions for accommodating both right- and left-handed batters according to another embodiment of the invention.

FIG. 3 illustrates the swing trainer 10 according to another embodiment of the invention. As illustrated in FIGS. 1*a* and 1*b*, the swing trainer 10 comprises two separate devices for a left-handed swing trainer and a right-handed swing trainer, juxtaposed with respect to one another so that the right-hand swing trainer faces outwardly from one lateral side of the device 10 and that the left-hand swing trainer faces outwardly from another lateral side of the device 10. The swing guides 16 for left-handed and right-handed batters can also be mounted to a single mounting post 14 to provide a swing trainer 10 that can accommodate both left and right-handed batters. For purposes of clarity in FIG. 3, the suffix "L" refers to components of a swing guide 16 for a left-handed batter and the suffix "R" refers to components of a swing guide for a right-handed batter. When combined as a single swing trainer device 10, the left and right-handed swing guides 16L and 16R, respectively, are mounted such that the first path members 18L and 18R and the second path members 20L and 20R are generally parallel to each other with channels 22L and 22R facing opposite lateral directions with respect to a central medial axis of the swing trainer 10.

Figure 4:
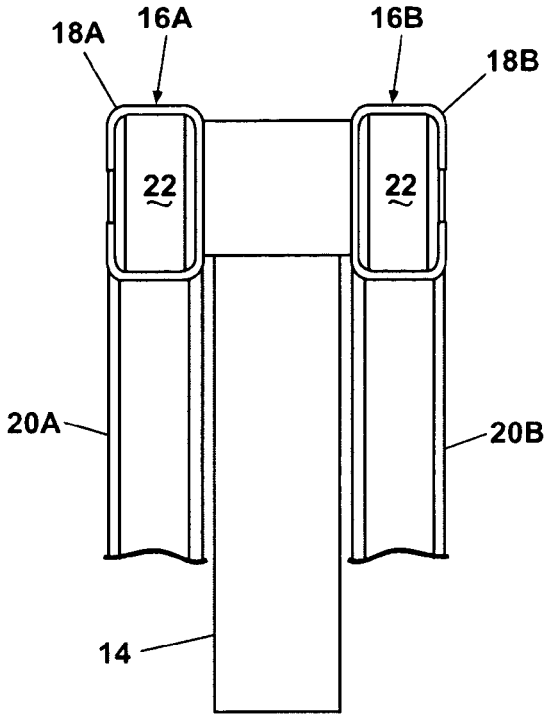
FIG. 4 is a front view of the swing training device for left and right-handed batters of FIG. 3.

The swing guides 16L and 16R may be mounted as a single unit to mounting post 14 or individually to mounting post 14. When mounted as a single unit, as illustrated in FIG. 3, the swing guides 16L and 16R may be connected with each other along the first path members 18L and 18R and the second path members 20L and 20R. The connection between the first path members 18L and 18R and the second path members 20L and 20R may be continuous along their entire length or discontinuous along one or both members without departing from the scope of this invention. The swing guides 16L and 16R can also be individually connected with the mounting post 14 along opposite sides of the mounting post 14. In this configuration, the mounting post 14 extends upwards between the swing guides 16L and 16R (see FIG. 4). A suitable connection for connecting the left and right-handed swing guides 16L and 16R and for mounting the swing guide 16 to the mounting post 14 include, but are not limited to, welding, adhesives, clamps and the like.

Figure 5:
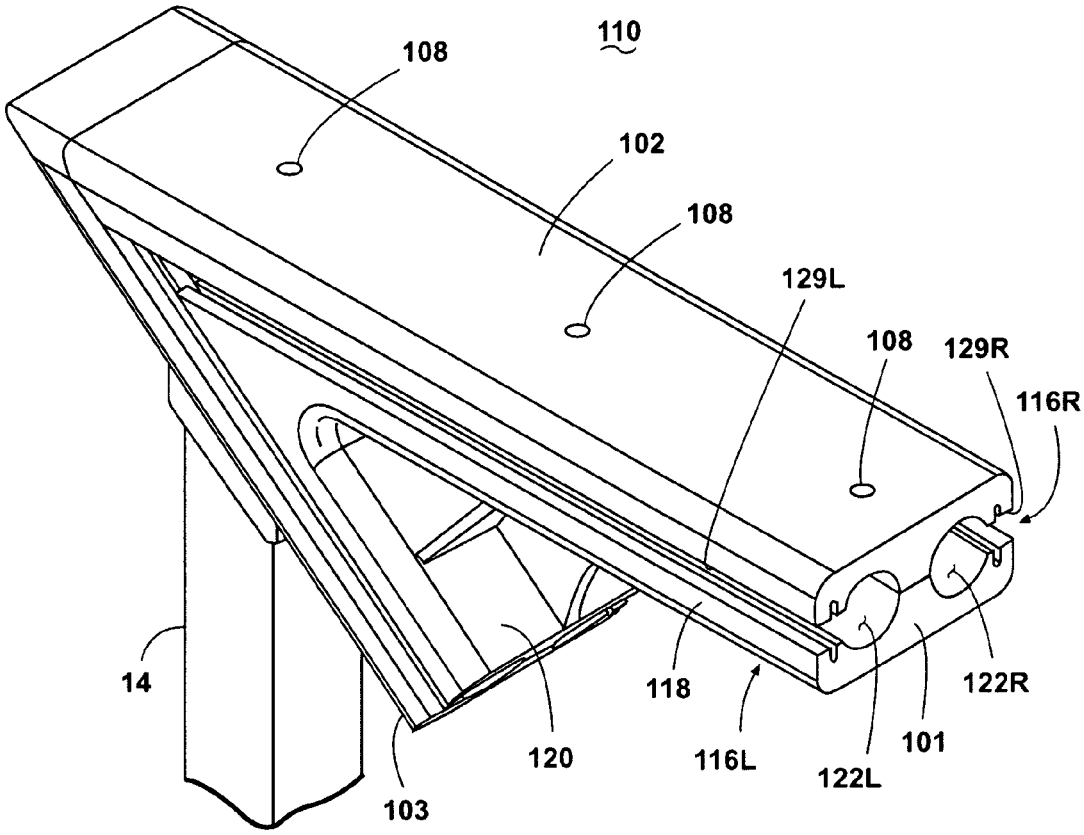
FIG. 5 is a schematic illustration of a baseball swing training device having portions for accommodating both right- and left-handed batters according to another embodiment of the invention.
Figure 6:
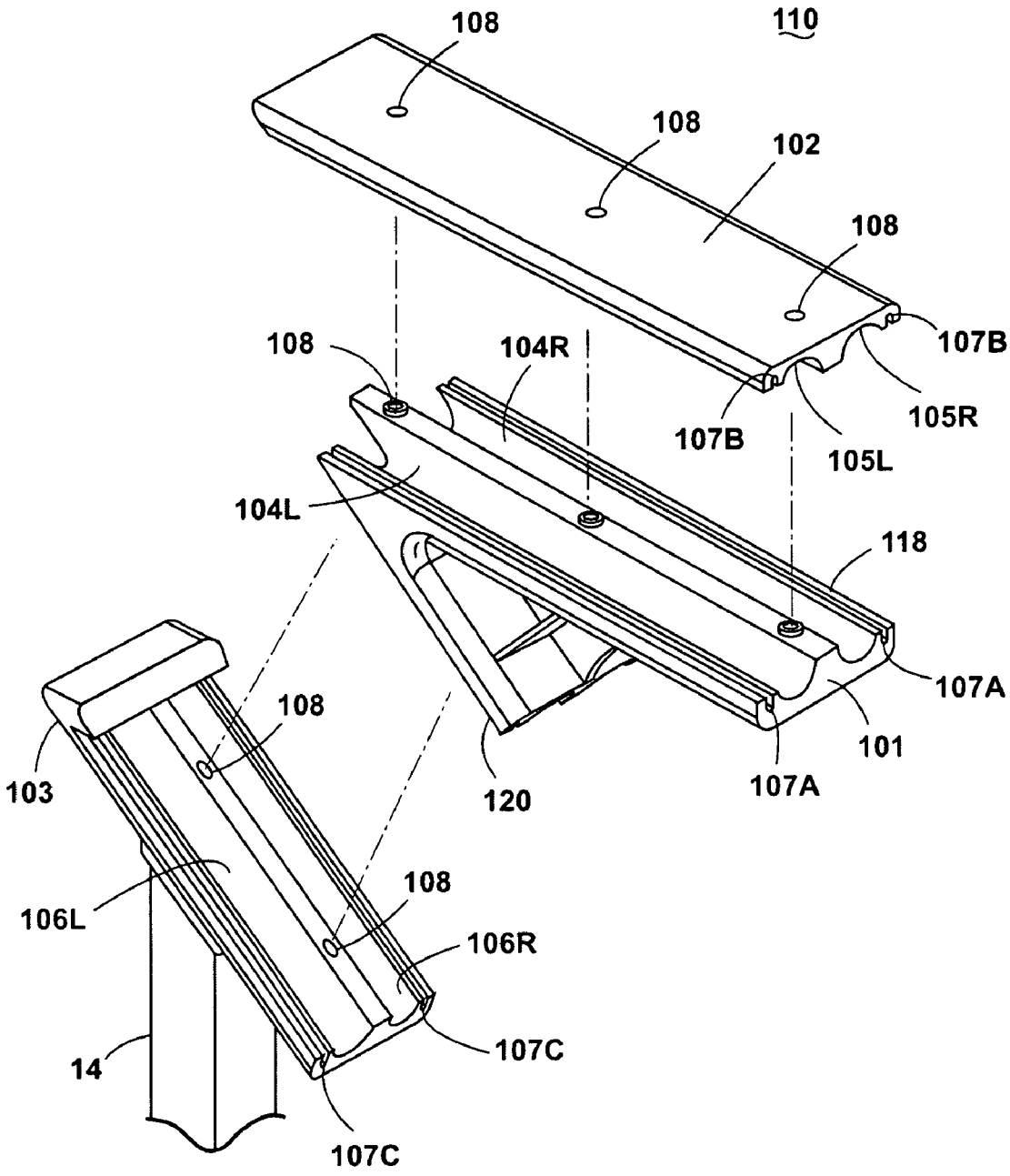
FIG. 6 is an exploded view of the baseball swing training device of FIG. 5.

FIGS. 5 and 6 illustrate a third embodiment of the invention comprising a swing trainer 110, which is similar to the swing trainer 10, except in the manner in which the swing guides are formed. Therefore, elements in the swing trainer 110 similar to those of the swing trainer 10 will be numbered with the prefix 100.

As illustrated in FIG. 5, swing trainer 110 comprises two separate swing guides 116 for accommodating both left and right-handed batters. For purposes of clarity, the suffix "L" refers to components of a swing guide 116 for a left-handed batter and the suffix "R" refers to components of a swing guide 116 for a right-handed batter. The left and right handed swing guides 116L and 116R, respectively, can be formed by a guide base 101, a first top guide 102 and a second top guide 103.

As can best be seen in FIG. 6, the guide base 101 can comprise a first, horizontal portion 118 and a second, angled portion 120 depending from one end of the horizontal portion 118. The angled portion 120 can depend angularly from one end of the horizontal member 118, preferably at an acute, forward-facing angle of 45 degrees, although it will be understood that other angles can be selected for the angled portion 120 with respect to the horizontal portion 118 without departing from the scope of this invention. In addition, it is also within the scope of the invention for the first portion 118 to be offset at an angle from horizontal. The guide base 101 can also be provided with a first pair of longitudinal grooves 104L and 104R that extend longitudinally along the length of the horizontal portion 118 from a first, forward open end to a second, rearward end from which the angled portion 120 depends and continue along the length of the angled portion 120 to a forward open end of the angled portion 120.

The first top guide 102 and the second guide 103 can also be provided with a second and third pair of longitudinal grooves 105L,R and 106L,R, respectively. In this manner, when the first top guide 102 and the second top guide 103 are coupled with the guide base 101, as illustrated in FIG. 5, the longitudinal grooves 104L, 105L and 106L cooperate to form a first channel 122L that extends continuously from the first, forward open end of the horizontal portion 118 to the rearward end and down along the angled portion 120 to the forward open end of the angled portion 120. A second channel 122R can be formed in a similar manner from longitudinal grooves 104R, 105R and 106R. The channels 122L and 122R are thereby defined by the cooperating and continuous grooves 104L, 105L and 106L and 104R, 105R and 106R, respectively, for slidably receiving the bearing 32 of the connecting member 26 in the same manner in which the bearing 32 is slidably received by the swing trainer 10 according to any of the previous embodiments.

The reduced width or neck portion of the connecting member 26 can extend unimpeded through a slot 129L and 129R formed between the guide base 101 and the first and second top guides 102 and 103 which communicates with the channels 122L, R, respectively, to facilitate the location of the bearing 32 within the channels 122L, R. In this manner, the swing trainer 110 can be used in a manner similar to that described above with respect to the swing trainer 10 to guide the movement of the swing implement 28 along a desired swing path through its interconnection to the connecting member 26.

The guide base 101 and first and second top guides 102 and 103 can also be provided with insertion slots 107*a, b* and *c*, respectively, which extend along the guide base 101 and first and second top guides 102 and 103 parallel with the channels 122L, R and adjacent to the slots 129L and 129R. The insertion slots 107*a, b* and *c* can be provided with an insert (not shown), such as water hardened steel, or other suitable material, to facilitate the movement of the connecting member 26 within the slots 129L, R. The insert 106 can be secured within the insertion slots 107*a, b* and *c* using any suitable type of mechanical fastener, such as one or more set screws, for example, and/or non-mechanical fastener, such as an adhesive.

The first and second top guides 102 and 103 can be secured to the guide base 101 using any suitable type of mechanical fastener, such as one or more set screws, for example, and/or non-mechanical fastener, such as an adhesive or weld. As illustrated in FIGS. 5 and 6, the guide base 101 and the first and second top guides 102 and 103 can be provided with a plurality of apertures 108 for receiving a plurality of screws for securing the first and second top guides 102 and 103 to the guide base 101. The second top guide 103 can be coupled with the mounting post 14 using any suitable method such as welding, adhesives, clamps and the like.

Figure 7:
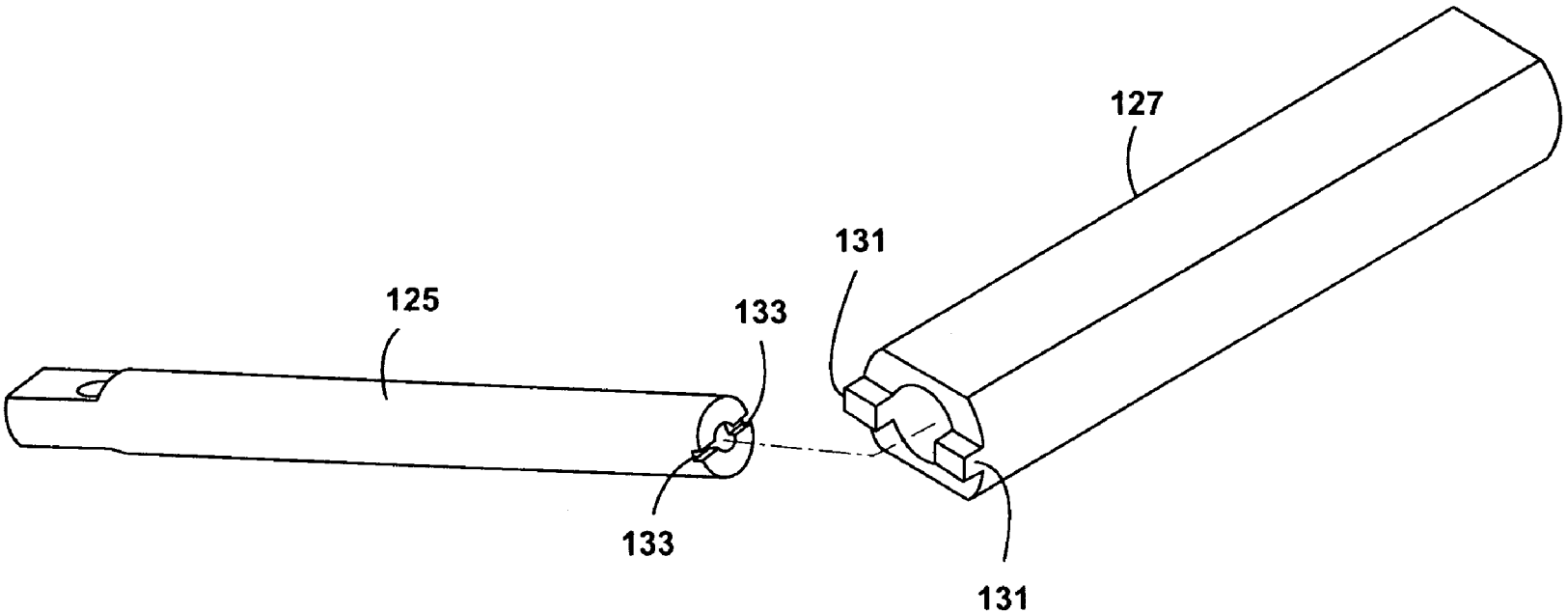
FIG. 7 is an exploded view of a connecting member according to another embodiment of the invention.

FIG. 7 illustrates a connecting member 126 according to another embodiment of the invention. The connecting member 126 can be used with the swing trainer 10 or the swing trainer 110 according to any of the previous embodiments. Connecting member 126 is similar to connecting member 26, except that the connecting member 126 comprises a selectively couplable insertion member 125 and guide member 127. The insertion member 125 can be selectively coupled with the swing implement 28 at a first end and the guide member 127 at a second end for coupling with the bearing 32. The insertion member 125 of the connecting member 126 can be coupled with the swing implement 28 using any suitable mechanical fastener, such as a screw, in any suitable location adjacent the knob of the swing implement 28. For example, the first end of the insertion member 125 can be received within a groove adjacent to or within the knob of the swing implement 28 and secured therein by a screw, either directly to the swing implement 28 or to an internal support structure, such as a metal rod, located within an interior of the swing implement 28. Alternatively, the insertion member 125 may be coupled with the swing implement 28 at the bottom thereof.

The guide member 127 can be in the form of a flattened cylinder, as illustrated in FIG. 7, such that at least a distal end or neck portion of the guide member 127 can be slidably received within the slot 29, 129 of the swing trainer 10 or 110, respectively. It is also within the scope of the invention for the guide member 127 to have any other regular or irregular shape so long as at least a neck portion of the guide member 127 can be slidably received within the slot 29, 129. The guide member 127 can comprise a first end for releasably coupling with the insertion member 125 and the second distal end or neck portion for releasably coupling with the bearing 32. For example, the neck portion of the guide member 127 can include a threaded aperture for receiving a threaded shaft extending from the bearing 32 for releasably coupling the bearing 32 to the guide member 127.

The first end of the guide member 127 can include a pair of alignment tabs 131 that mate with a pair of recesses 133 in the second end of the insertion member 125 for facilitating consistent coupling of the insertion member 125 and the guide member 127 so as to limit rotation of the guide member 127 with respect to the insertion member 125. The guide member 127 can be releasably secured to the insertion member 125 using one or more mechanical fasteners, such as set screws (not shown). In one example, the guide member 127 can include an extension projecting from the first end, between the alignment tabs 131, that can be received within a cavity extending from the second end of the insertion member 125 into an interior of the insertion member 125. One or more holes can be provided perpendicular to the cavity for receiving a suitable mechanical fastener, such as a screw, which can be tightened so as to bear down on the extension. In this manner the extension can be secured within the cavity, thus securing the guide member 127 with the insertion member 125.

In another example, the second end of the insertion member 125 can include a hollow sleeve extending from the second end, encompassing the recesses 133. The first end of the guide member 127 can then be inserted into the sleeve such that the alignment tabs 131 mate with the recesses 133 and releasably secured therein by one or more mechanical fasteners extending from an exterior of the sleeve and pressing against the portion of the guide member 127 within the sleeve. The exact manner of coupling the guide member 127 and the insertion member 125 are not germane to the invention, therefore variations known to those skilled in the art can be used without deviating from the scope of the invention.

As discussed previously, the second end or neck portion of the guide member 127 is sized to be slidably received within the slot 29, 129. It is also within the scope of the invention to provide several different guide members 127, each having a different thickness that is still slidingly received within the slot 29, 129. The different guide members 127 can be provided with different thickness such that the tolerance between the guide member 127 and the vertical dimensions of the slot 29, 129 can be varied depending on the skill level of the batter.

For example, batters at a beginner level can use a guide member 127 having a thickness that provides a higher tolerance than a guide member 127 that a batter at a more advanced level might use. A thinner guide member 127 provides a higher tolerance between the guide member 127 and the slot 29, 129, which allows for some deviation from the preferred swing path as the bearing 32 is moved within the channel 22, 122 in the course of a swing without inhibiting the fluid movement of the bearing 32 within the channel 22, 122. As the batter's skill level improves, different guide members 127 having increasing thickness can be selectively coupled with the insertion member 125 and the bearing 32 to allow less and less deviation from the preferred swing path, such that the amount of deviation allowed by the swing trainer 10, 110 prior to resisting the fluid movement of the bearing 32 within the channel 22, 122 decreases as the skill level of the batter increases.

It is also within the scope of the invention for the guide member 127 to have a different dimension in both a first, lateral axis and a second, dorsoventral axis, both of which are still sized to be slidably received by the slot 29, 129. The guide member 127 can then be rotated relative to the insertion member 125 such that the dimensions along the first and second axes can be used to allow varying amounts of deviation from the preferred swing path according to the skill level of the user.

As illustrated in FIGS. 1-6, the swing trainers 10 and 110 can be coupled with the mounting post 14 for mounting to a floor stand 40 as illustrated by the swing trainer 10 of FIG. 1. It is also within the scope of the invention for the swing trainer 110 to be mounted to the floor stand 40 in a manner similar to the swing trainer 10. The mounting post 14 can be telescopically received by a support post 42 extending upwards from the floor stand 40. The support post 42 can comprise a locking pin 44 for locking the vertical position of the mounting post 14 relative to the support post 42. A locking pin 44 can lockingly engage the mounting post 14 through pre-drilled apertures or openings in the mounting post 14. The locking pin 44 can also be a screw or other mechanical device that applies pressure to the mounting post 14 to keep the mounting post 14 at a desired vertical position relative to the support post 42. Other mechanical means for securing the position of the mounting post 14 within the support post 42 include clamps or straps. It will be understood that the vertical positioning of the swing guide 16, 116 with respect to the surface on which it is mounted can be discrete (e.g., a series of mounting holes employing a retainer pin for positioning) or continuous (e.g., a clamp-type device) or other suitable retainer can be employed without departing from the scope of this invention.

Figure 8A:
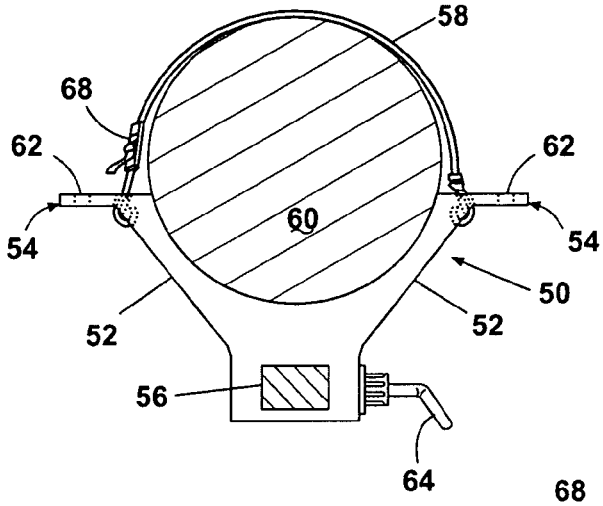
FIGS. 8*a* through 8*c* are a top view of a bracket for mounting the swing training device according to any of the previous embodiments to an external structure according to the invention.
Figure 8B:
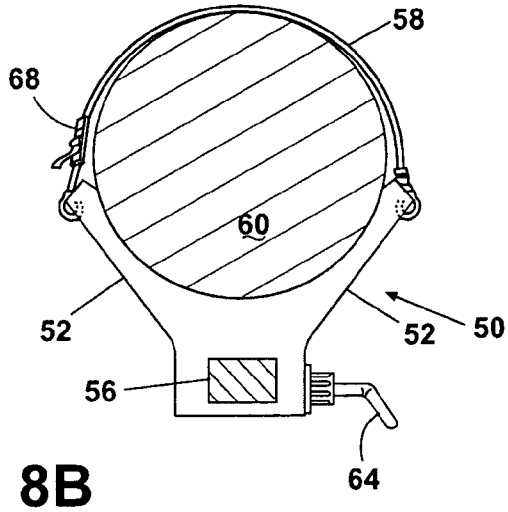

As illustrated in FIGS. 8A and 8B, a mounting bracket 50 can also be used to telescopically mount the swing trainer 10 and 110 to a post, a fence or a wall. Mounting bracket 50 comprises a pair of arms 52 and an opening 56 for receiving the mounting post 14. A pair of flanges 54 comprising a set of apertures 62 for mounting the bracket 50 to a wall can extend from the arms 52 as illustrated in FIG. 8A or need not be present as illustrated in FIG. 8B. The arms 52 can be set an angle relative to each other for engaging a post such as a fence post. A strap 58 can extend between the arms 52 for securing the bracket 50 to a post. The strap 58 extends from one arm 52 to the opposite arm 52 to define a space 60 for receiving a post. The strap 58 comprises an apparatus such as a standard ratchet assembly 68 for adjusting the length of the strap, and thus the size of the space 60, for tightening the bracket 50 against a post. Other suitable straps, clamps or retainers can be employed without departing from the scope of this invention.

Figure 9:
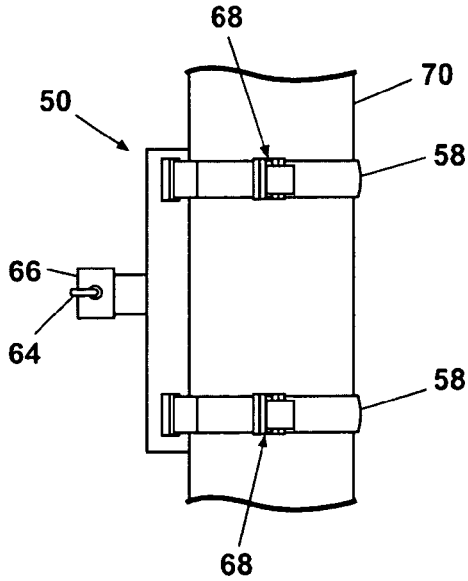
FIG. 9 is a side perspective of a bracket for mounting the swing training device according to any of the previous embodiments to an external structure according to the invention.

The bracket 50 can comprise a single strap or multiple straps, as illustrated in FIG. 9, for securing the bracket 50 to a post. A locking pin 64 secures the mounting post 14 within the opening 56 in much the same way the locking pin 44 functions to secure the mounting post 14 to the support post 42 as described above with reference to FIG. 1. The locking pin 64 can lockingly engage the mounting post 14 through pre-drilled apertures or openings in the mounting post 14 or apply pressure to the mounting post 14 to releasably lock the mounting post 14 in a desired position. In this way, the vertical position of the mounting post 14 within the opening 56 can be selectively adjusted and locked into place using the locking pin 64. The height of the swing trainer 10, 110 relative to a batter can be changed by adjusting the position of the bracket 50 on the post, adjusting the position of the mounting post 14 within the opening 56 of the bracket 50, or a combination of both. It will be understood that the vertical positioning of the swing guide 16 with respect to the surface on which it is mounted can be discrete (e.g., a series of mounting holes employing a retainer pin for positioning) or continuous (e.g., a clamp-type device) or other suitable retainer can be employed without departing from the scope of this invention.

Figure 8C:
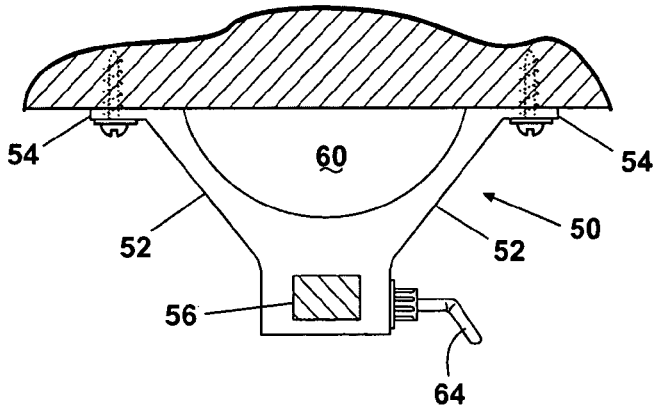

As illustrated in FIGS. 8A and 8C, the flanges 54 extend from the arms 52 and can be used to secure bracket 50 to a wall. The apertures 62 present in the flanges 54 can be used for securing the bracket 50 to a wall using screws or other mechanical means. Each flange 54 can contain one or more apertures for receiving screws or the like for securing the bracket 50 to a wall.

While FIGS. 8A through 8C illustrate the bracket 50 as defining a generally circular opening 60, the bracket 50 can also be shaped to define any other regular or irregular shape such as a square, rectangular, triangular or trapezoidal, for example. The bracket 50 can be mounted to a post of any shape including generally circular, rectangular, oval or square shaped posts. It is also contemplated that the bracket 50 can mount the swing guide 16 to a post of a different, non-complementary shape by virtue of a clamping force applied to or by the bracket 50 to the post.

Figure 10:
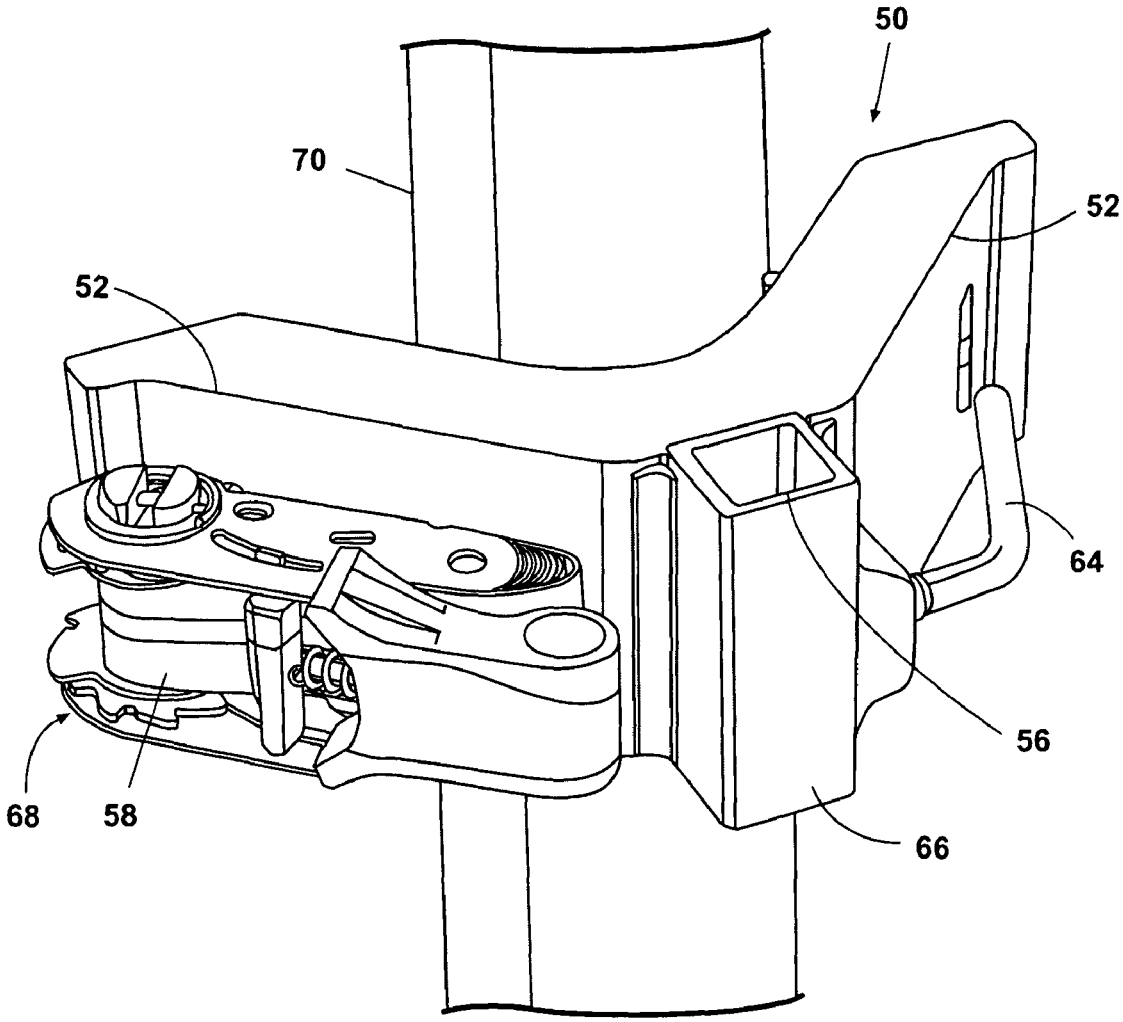
FIG. 10 is a perspective view of a bracket for mounting the swing training device according to any of the previous embodiments to an external structure according to the invention.

FIG. 10 illustrates an exemplary bracket 50 for mounting the swing trainer 10, 110 to a post. As illustrated in FIG. 7, the bracket 50 is mounted to the post 70 using a ratchet system 68. The ratchet system 68 for tightening the strap 58 is mounted at one side of the bracket 50 on an arm 52. The strap 58 extends from one arm 52 to the other arm 52 where it is secured using the ratchet system 68. The mounting post 14 is inserted through the opening 56 and releasably locked within a chamber 66 by the locking pin 64.

The embodiments of the swing trainer 10 and 110 as illustrated in FIGS. 1-6 can be mounted according to any of the embodiments as illustrated in FIGS. 8-10 without departing from the scope of this invention.

The attachment members 26 and 126 are of sufficient length to offset the swing implement 28 at a distance from the swing guide 16 to allow a batter to use the swing trainer 10 without interference that could injure the batter or limit use of the device. The bearing 32 guides the swing implement 28 through the connecting member 26, 126 along a path that is parallel and offset to the path defined by the channel 22. The swing implement 28 is guided along the channel 22 from the starting point at the open end of the first path member 18 to the exit point at the end of the second path member 20. Since the swing implement 28 is connected to the bearing 32 through the connecting member 26, 126, the swing implement 28 is restricted to moving along the path that the bearing 32 travels as defined by the channel 22 of the swing guide 16. If a batter attempts to move the swing implement 28 along a path not defined by the swing guide, the batter will feel a physical resistance to the movement and the bearing 32 will not move smoothly through the channel 22.

The attachment members 26 and 126 can be used with the swing trainer 110 in the same manner as with the swing trainer 10. The bearing 32 guides the swing implement 28 through the connecting member 26, 126 along a path that is parallel and offset to the path defined by the channel 122. The swing implement 28 is guided along the channel 122 from the starting point at the open end of the horizontal member 118 to the exit point at the end of the second path member 120. Since the swing implement 28 is connected to the bearing 32 through the connecting member 26, 126, the swing implement 28 is restricted to moving along the path that the bearing 32 travels as defined by the channel 122 of the swing guide 16. If a batter attempts to move the swing implement 28 along a path not defined by the swing guide, the batter will feel a physical resistance to the movement and the bearing 32 will not move smoothly through the channel 122.

The connecting member 126 can be provided with a singe guide member 127 or a plurality of different guide members 127 having different thicknesses that allow the batter to deviate from the path defined by the swing guide 16, 116 to varying degrees before providing physical resistance to the batter. Beginners who are in the early stages of learning how to swing a bat can use a thinner guide member 127 that allows for a larger deviation from the path defined by the swing guide 16, 116. In this manner the movement of the swing implement 28 is less restricted and beginners can use the swing guide 16, 116 without becoming overly frustrated. As the skill level of the batter increases, guide members 127 having increasing thickness can be selectively coupled with the insertion member 125 which allow for smaller and smaller deviations from the path defined by the swing guide 16, 116. In this manner, the movement of the swing implement 28 can become more and more restricted such that less deviation from the defined swing path is allowed, which can promote the development of a proper swing over time.

FIGS. 11-15 illustrate an example method of using the swing trainer 10 in the development of a proper swing, as illustrated in FIG. 1*b*, for a right-handed batter according to an embodiment of the invention. While the method is described in the context of the swing trainer 10, it is within the scope of the invention for the method to be used in a similar manner with the swing trainer 110. The steps for a left-handed batter using the swing trainer 10 as illustrated in FIG. 1*a*, will be identical, but mirror images of the steps described for a right-handed batter. Switching between left-handed and right-handed hitting is well known in the fields of baseball and softball and will not be discussed in detail here.

Figure 11:
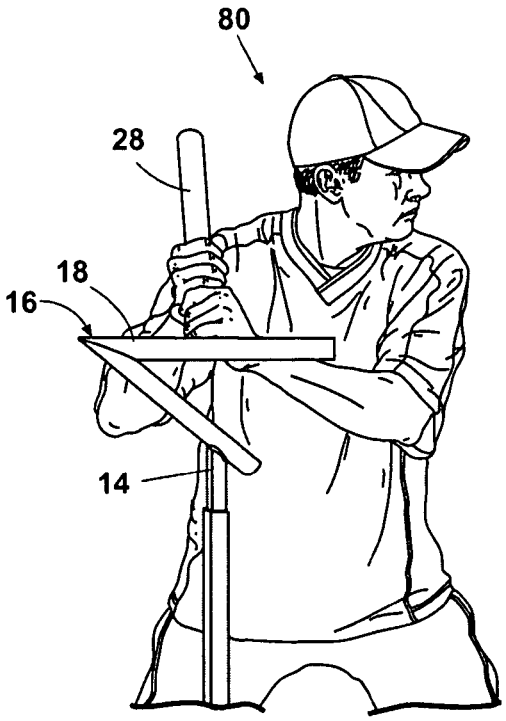
FIGS. 11 through 15 show the progressive movement of a right-handed batter using the training device of FIG. 1*b*. It will be understood that, although a right-handed batter is shown in FIGS. 11-15, this example is by way of illustration and not limitation, and that the drawings can apply equally to left-handed batters as well.

FIG. 11 illustrates a batter 80 in a starting position. Before batter 80 gets into the starting position, the height of the swing trainer 10 is adjusted such that the first path member 18 is located approximately between the chest and shoulders of the batter 80. As a right-handed batter using the right-handed swing trainer 10 of FIG. 1*b*, the batter 80 will step up to the swing trainer 10 such that his left shoulder is his leading shoulder and is aligned with the direction of the entry and exit points of the swing guide 16. The batter 80 then inserts the bearing 32 of the connecting member 26 into the channel 22 at the open end of the first path member 18. This engages the swing implement 28 with the swing guide 16. The batter 80 then grips the swing implement 28 using a two-handed grip known in the art of baseball. To complete the starting position, the batter 80 adjusts his shoulders and his feet so that they are parallel with the first path member 18 and moves the swing implement 28 to a position approximately half way down the length of the first path member 18. The batter 80's hands are approximately in-line with the mounting post 14. It will be understood that the particular axial starting position of the bat for each batter may be a case of individual preference and any particular starting position of the bat with respect to the swing trainer should not be interpreted as limiting on the scope of the invention.

The connecting member 26 can be coupled with the swing implement 28 at any suitable angle, but is preferably coupled with the swing implement 28 such that when the swing implement 28 is grasped by the batter in the initial starting position, the batter's left forearm (of the leading arm) extends from the batter's left hand at an angle, positioning the wrist a preferred angle. When the bearing 32 is placed in the first path member 18, the swing implement 28 is held at an angle such that when a batter grips the bat, the batter's leading wrist is positioned at the preferred angle.

Figure 12:
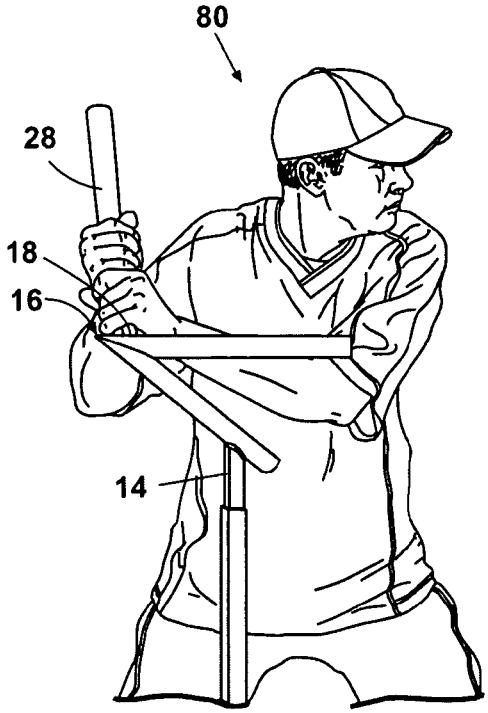

The next step, as illustrated in FIG. 12, is a load step. The swing guide 16 only allows the batter 80 to move the swing implement 28 along the first path member 18 until the hands of the batter 80 are lined up with the end of the first path member 18 that is connected to the second path member 20. During this process, the movement of the swing implement 28 (via the connecting member 26) moves the bearing 32 along the channel 22 in the first path member 18 (see FIG. 2*a*). Since the swing implement 28 and the bearing 32 are connected at a fixed distance through the connecting member 26, the batter 80 is prevented from loading with the upper body by rotating the shoulders instead of simply moving the hands back. The batter 80 will know that he has properly loaded his swing when the load step is completed smoothly with neglible resistance. Any inappropriate loading, such as rotating the shoulders, results in an unsmooth motion due to interference from the swing guide 16. The swing guide 16 provides resistance to the batter 80 when taking inappropriate swing steps due to the connection of the swing guide 16 with the swing implement 28 through the connecting member 26. Thus, the swing trainer 10 teaches batters how to avoid one of the most common mistakes made at the beginning of a baseball swing.

Figure 13:
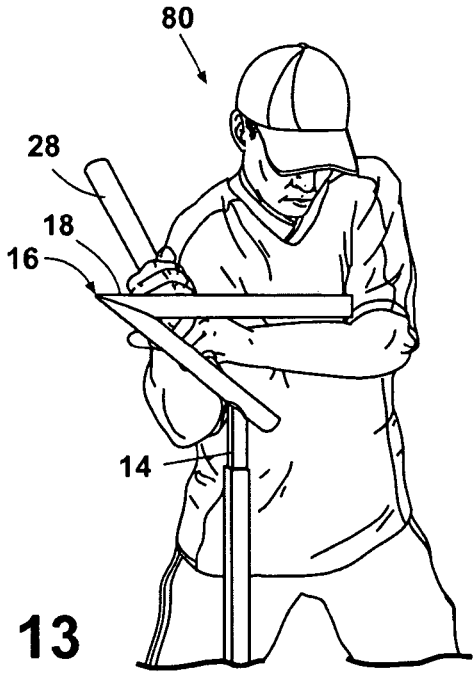
Figure 14:
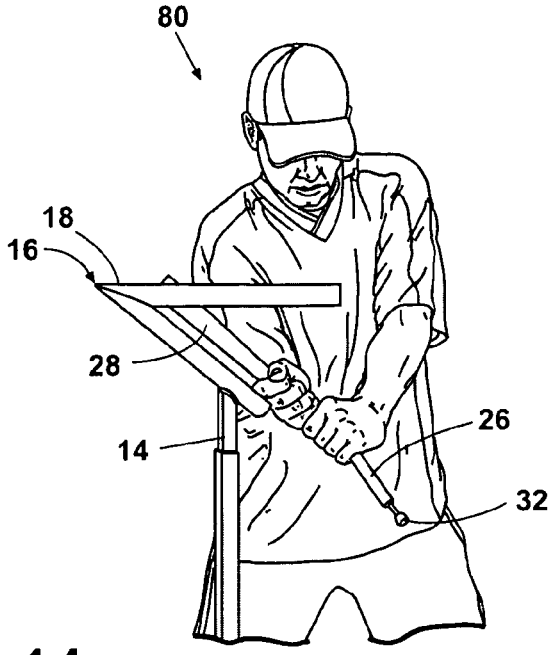

FIGS. 13 and 14 illustrate a hand path to the ball. From the loaded position illustrated in FIG. 12, the swing guide 16 directs the hands of the batter 80 down the correct path and angle to what is called the contact point in the swing. This is the point at which a batter, when receiving a pitched ball will come into contact with the ball to produce a hit. As described in reference to FIG. 12, the swing guide 16 directs the movement of the swing implement 28 and thus the hands of the batter 80 through the bearing 32 which is moving along the channel 22 in the second path member 20. Since the connecting member 26 connects the bearing 32 to the swing implement 28, the swing implement 28 is forced to follow the path that the bearing 32 is limited to. If the swing implement 28 attempts to deviate from the path defined by the swing guide 16 due to the batter 80 making incorrect movements during the course of his swing, the bearing 32 will not move smoothly through the channel 22 and the batter 80 will recognize this unsmooth movement as a sign that he is taking incorrect steps. The batter can then adjust his swing until he completes the movement smoothly with little resistance from the swing guide 16. This part of the swing process using the swing trainer 10 forces the batter's hand to stay inside and behind the ball, both crucial steps in completing a correct swing.

Figure 15:
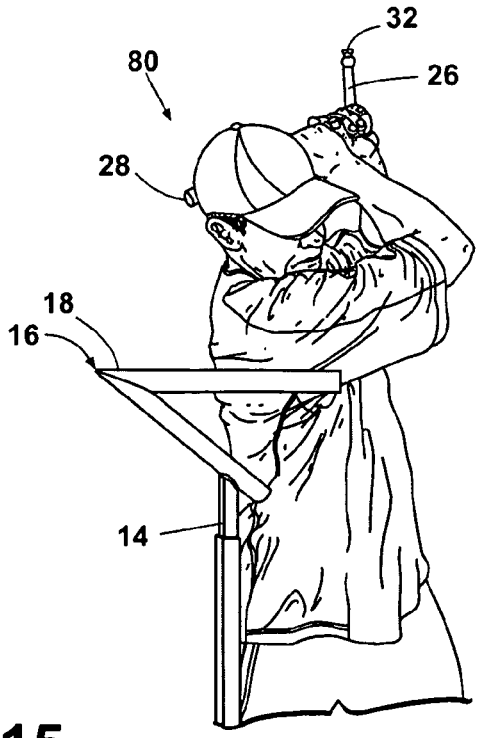

FIG. 15 illustrates a final step of the swing which is the follow through and finish. As the hands of the batter 80 pass through the hand path to the ball, the swing guide 16 continues to direct the swing implement 28 down the path defined by the channel 22 in the second path member 20. The second path member 20 ends at the point in the path when the follow through is complete and the batter 80 may finish his swing. The second path member 20 is open at its end such that the bearing 32 exits the channel 22 as the batter 80 pulls the swing implement 28 down the follow through path to the finish point as illustrated by the batter 80 in FIG. 14. At the finish point, the bearing 32 has exited the channel 22 and thus the swing implement 28 is no longer in contact with the swing guide 16.

The swing implement 28 is connected with the swing guide 16 at a fixed distance through the connecting member 26 and the bearing 32 from the start of a swing to the finish. This prohibits the batter 80 from fluidly moving swing implement 28 from start to finish without using proper technique. The swing guide 16 provides resistance to incorrect movement of the swing implement 28 and interrupts the fluid motion of the swing of the batter 80. This provides instant feedback to the batter 80, allowing the batter 80 to feel and know when he has completed a correct swing from start to finish.

Figure 16:
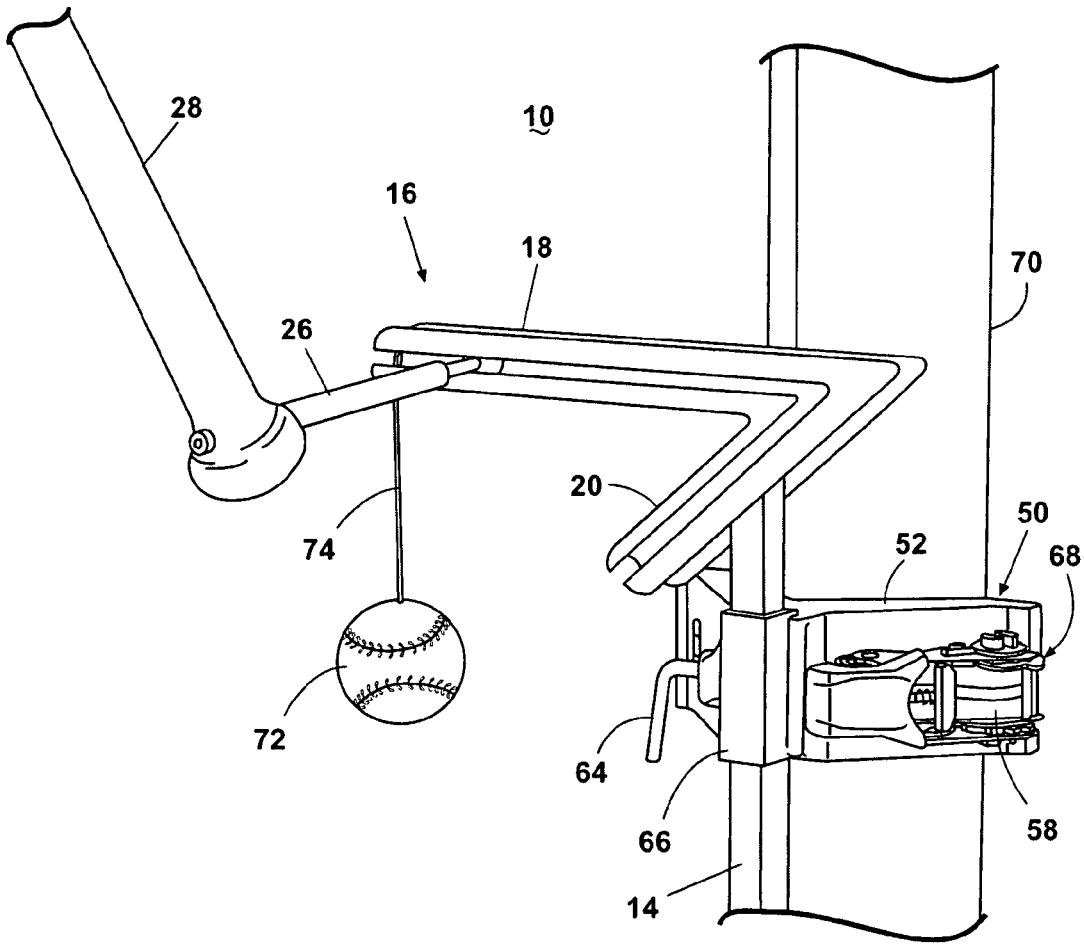
FIG. 16 is a schematic illustration of a baseball swing training device with a suspended ball according to another embodiment of the invention.

FIG. 16 illustrates a swing trainer 10 with a ball 72 suspended from the swing guide 16 by a connector 74 according to an embodiment of the invention. The ball 72 can also be used with the swing trainer 110 in a similar manner without deviating from the scope of the invention. The ball 72 is suspended from the swing guide 16 at the end of the first path member 18. The ball 72 need not be a baseball as illustrated, but can be any other type of ball such as a softball or golf ball and need not be a ball at all, but rather any sort of target at which the batter can aim. The connector 74 can be any suitable physical connector such as a rope, a chain, a tube or a strap, for example. The connector 74 can be rigid or flexible. The suspended ball 72 can be used with any of the embodiments of the invention illustrated in any of the appended drawings.

The embodiment of the invention illustrated in FIG. 16 does not change the method of use of the swing trainer 10 as illustrated in FIGS. 11-15. The suspended ball 72 provides an additional feedback mechanism to the batter 80 during the swing. When the hands of the batter 80 travel through the hand path to the ball as illustrated in FIGS. 13 and 14, the head of the swing implement 28 passes between the first path member 18 and the second path member 20. If the suspended ball 72 is present, the swing implement 28 will contact the suspended ball 72 as the batter 80 completes the hand path to the ball as illustrated in FIG. 14. The length of the swing implement 28 is sufficient to allow it to pass between the first path member 18 and second path member 20 and contact the ball. The batter 80 can then finish the swing as illustrated in FIG. 15. If the batter 80 does not perform the hand path to the ball part of the swing correctly, the swing implement 28 may partially or completely miss contacting the suspended ball 72. This provides instant feedback to the batter 80 on the quality of the swing prior to and during contact with the ball in addition to the feedback from the swing guide 16 during the course of the entire swing.

Figure 17:
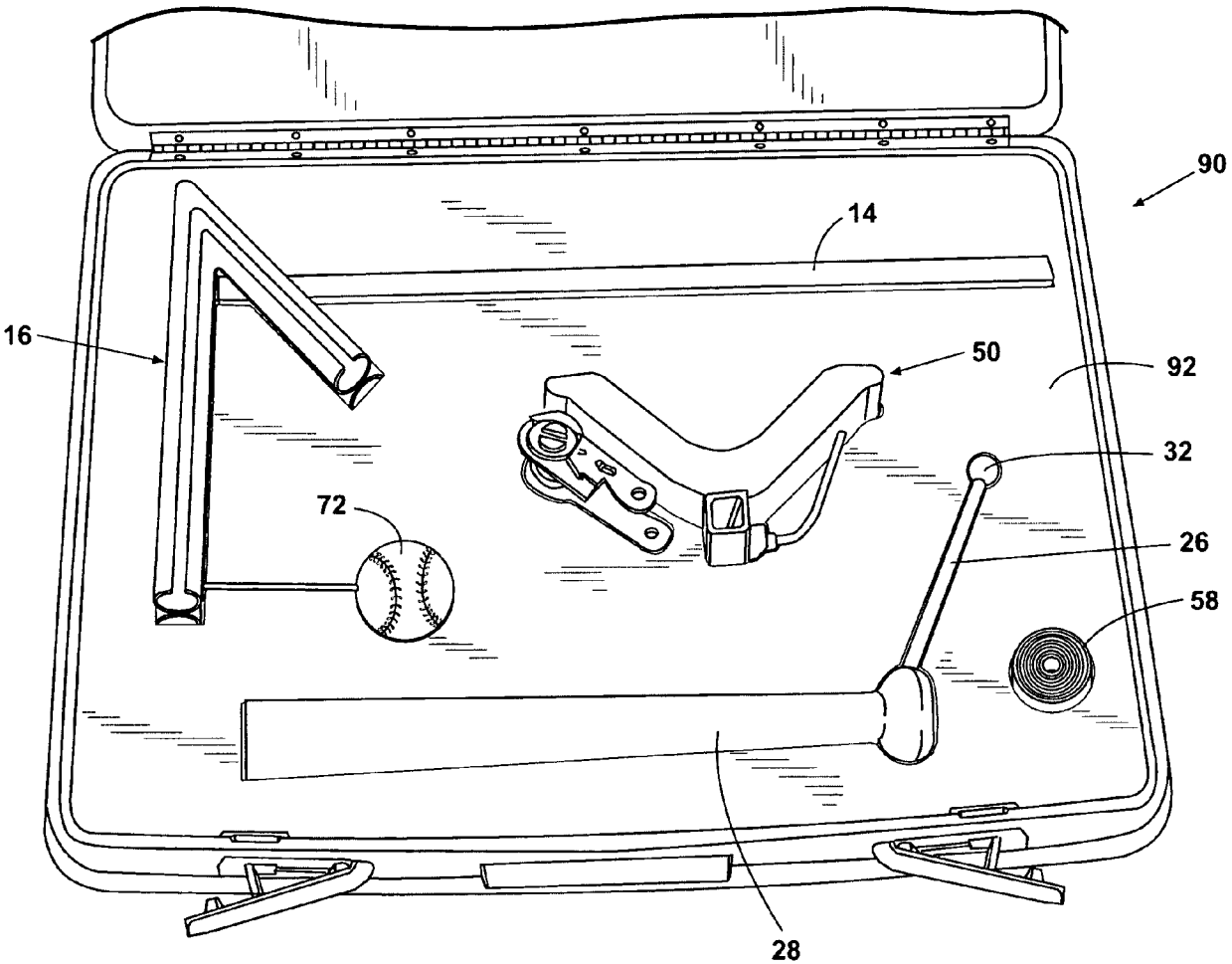
FIG. 17 is a schematic illustration of a case for a baseball swing training device according to any of the preceding embodiments of the invention.

FIG. 17 illustrates a case 90 for storing and transporting the swing trainer 10 according to any of the preceding embodiments of the invention. The case 90 comprises an insert 92 with indentations or cut-outs that extend partially or entirely through the depth of the insert 92 for receiving parts of the swing trainer 10. The case 90 can also be used with the swing trainer 110. The case 90 can be a hinged suitcase type of container, as illustrated, or any other type of container such as a box with a lid or a bag, for example. The case 90 can be of any regular or irregular shape including square, rectangular, oval or circular, and can be made from a hard or soft material such as wood, plastic, and canvas for example. The insert 92 can be made of a hard or soft material such as wood, plastic and/or foam, for example.

As illustrated in FIG. 17, insert 92 has indentations in its surface corresponding to pieces of the swing trainer 10 including the mounting arm 14, swing guide 16, suspended ball 72, bracket 50, swing implement 28, connecting member 26, bearing 32 and strap 58. It is contemplated that there are numerous ways to organize the shape, size and number of indentations or cut-outs in the insert 92 depending on the size of the case 90 and the degree to which the swing trainer 10 is assembled or disassembled.

Figure 18:
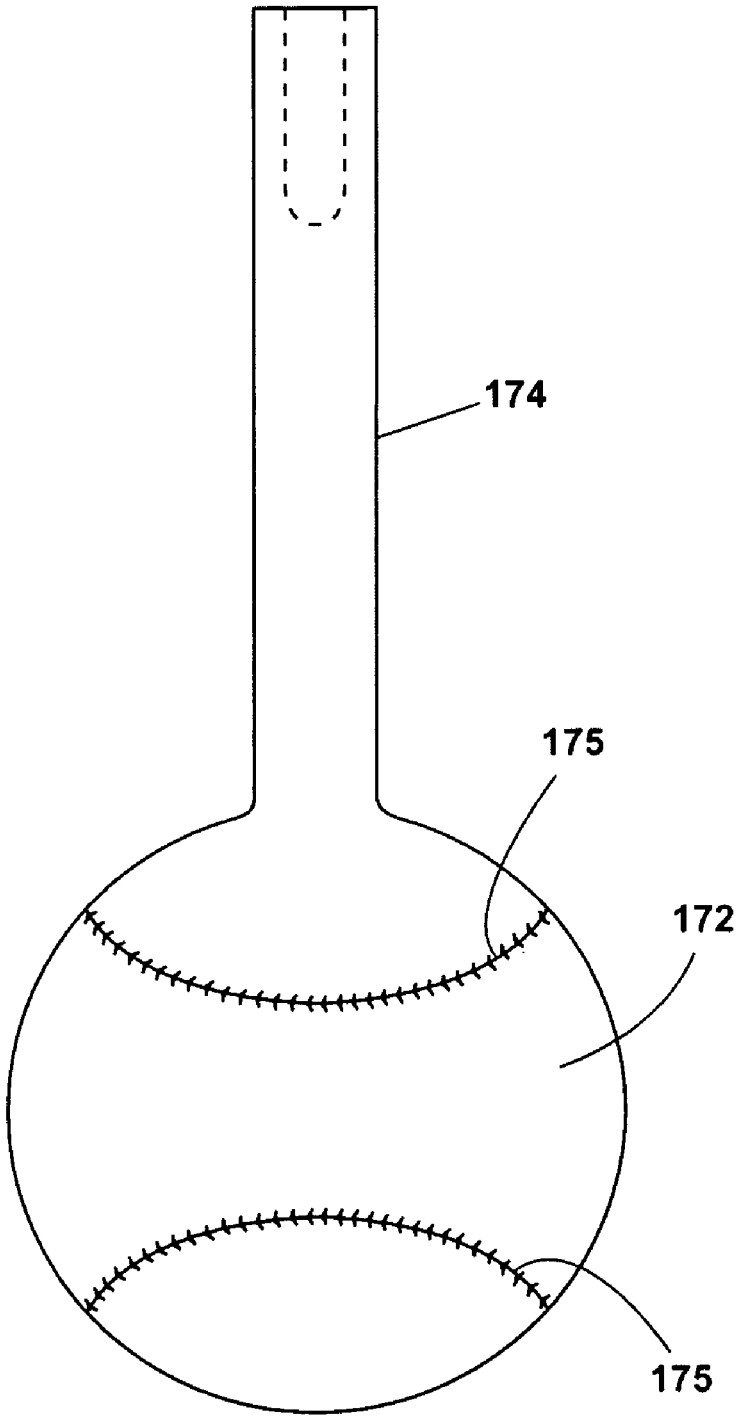
FIG. 18 is a schematic illustration of a molded ball having an integrally molded connector according to another embodiment of the invention.

As illustrated in FIG. 18, rather than using a separate ball 72 and connector 74, as illustrated in FIG. 16, an integrally molded ball 172 and connector 174 can be used. The ball 172 and connector 174 can be integrally molded as a single piece of hard or resilient material. For example, the ball 172 and connector 174 can be molded from natural or synthetic rubber. The ball 172 and connector 174 can be provided in any suitable shape, size or color and can be provided with distinguishing marks, such as the simulated seams 175. The mold used to form the ball 172 can include a series of indentations such that the resultant molded product has a series of raised bumps which simulate the seams on a baseball.

The swing trainer according to the invention provides a single device that can train a batter to use correct form and can act as a muscle memory trainer throughout the course of an entire baseball swing from start to finish. The shape of the swing guide and its slidable connection with the swing implement at a fixed distance through the course of the swing provides instant feedback to the batter whenever he or she takes incorrect steps. The suspended ball provides additional feedback to the batter every time he or she completes a swing. The swing trainer can help a batter overcome several of the most common mistakes made by batters, including: loading with the upper body (by rotating the shoulders instead of just taking the hands back), barring with the lead arm which does not allow the hands to take the proper path down to the ball, flattening of the wrist of the bottom hand, dropping the back shoulder, opening of the hips too early in the swing, casting of the bat head which causes the batter to roll the top hand over too soon, and lunging or drifting during the course of the swing. The swing trainer is the only device that can help a batter overcome these common mistakes and is safe for both the batter and any other people that may be nearby. Its full swing training and guidance capabilities, small size, simple construction, portability, adjustability and multiple mounting options make it a versatile addition to any softball or baseball training regime from leagues for children to professional teams.

The swing trainer of the present invention is preferably a muscle memory trainer that assists a batter in improving his/her swing for playing sports in which a ball is to be struck by the batter, such as in baseball and softball, although other players of other sports can use the device and method contemplated herein without departing from the scope of this invention. The device according to the invention is a free-standing device that preferably forces the batter to maintain the correct form through the entire course of a swing. The device automatically puts the batter in a desired starting position when the batter is positioned with respect to the device. The device is also adjustable to a desired height (of a generally vertical position between the batter's chest and shoulder) for each individual batter, who can range from a small child to a grown adult, i.e., from "tee-ball" to Major League size.

Once the batter is positioned with respect to the device and a desired operating height of the device with respect to the batter's initial swing position is set, the batter grips the bat and is now in a desired starting position. The device and method according to the invention then assists the batter in "loading" the bat as the next step in the training for the batter using the device. The "load" is essential in a proper swing for maximum power and energy, and can be described as a smooth horizontal movement of the hands away from the pitcher to preferably place the bat in a further rearward position to assist the batter in generating maximum forward energy when contacting the pitched ball. Once the hands are moved into the loaded position (also known as the power position), the batter is ready to move his/her hands to the ball. The device then guides the batter's hands down the correct path and angle to the contact point in the swing and, at the same time, forces the batter's hands to stay inside and behind the ball which are both crucial in a proper swing. As the batter continues the swing, the guided bat exits the device allowing the batter to finish the swing with a full follow through and then reset the bat back into the starting position, to prepare to load the bat for the next swing.

The swing trainer according to the invention provides feedback on how the load and bat path should feel in a proper swing. The device and system according to the invention also preferably eliminates any unnecessary movements that can lead to an improper swing. Three The swing trainer device and method according to the invention prevents many of the most common types of mistakes from happening by allowing fluid movement of the batter's hands only if the proper technique is used. If the proper technique is not employed by the batter, the batter's bat will bind in the device and prevent the batter's hands from continuing on their current course, giving the batter instant feedback and allowing the batter to feel and know when he or she has successfully executed a proper load and swing path.

Once a proper swing technique is mastered by a batter using the device and method of the invention, repetitive use of the device and method of this invention will instill muscle memory needed by a batter for a more powerful and consistent swing, and the device and method of the instant invention teaches batters the correct hand and bat path movements for a proper swing.

While the invention has been specifically described in connection with certain specific embodiments thereof, it is to be understood that this is by way of illustration and not of limitation, and the scope of the appended claims should be construed as broadly as the prior art will permit.

What is claimed is:

1. A swing training device comprising:

a swing guide having first and second channels therein, each of the first and second channels having a rearward end, the second channel positioned in a downward and forward angular position with respect to the first channel, and an acute angle portion, wherein the acute angle portion interconnects the rearward end of the first channel with the rearward of the second channel, the first and second channels having a lateral opening extending generally along their length;

a mount adapted to position the swing guide at a height above the ground selected by a user; and a swing implement comprising a first end, a second end, a handle portion therebetween for gripping by a user, and a connector portion adapted to be received in the channels, whereby when the user's hand is positioned on the handle portion adjacent the first end of the swing implement, the connector portion is mounted to the swing implement generally between the first end and the handle portion thereof, the connector portion having a distal end thereon, which, when the swing implement is used with the swing guide, movement of the first end of the swing implement is restricted by a path defined by the movement of the distal end of the connector portion through the first channel, through the acute angle portion, and into the second channel to train the user in a proper swing motion.

2. The swing training device of claim 1 wherein when the distal end of the connector portion of the swing implement is slidably mounted within at least one of the first and second channels with the connector portion extending through the lateral opening thereof, movement of the swing implement is maintained along a desired swing path defined by the interconnection of the first and second channels.

3. The swing training device of claim 1 wherein the distal end of the connector portion has a tip generally corresponding in size to a size of at least one of the first and second channels, and a neck generally corresponding in size to the lateral opening in the first and second channels.

4. The swing training device of claim 3 wherein the size of the tip on the distal end of the connector portion is larger than the size of the neck.

5. The swing training device of claim 2, wherein the connector portion further comprises a neck portion which extends through the lateral opening in the first and second channels when the distal end of the connector portion is positioned within the first and second channels, and wherein the connector portion can be provided with neck portions having different thicknesses to provide greater precision in swing training, whereby as the thickness of the neck portion of the connector portion approaches the thickness of the lateral opening of the first and second channels, the user must maintain the handle portion much closer to a desired swing path.

6. The swing training device of claim 1 wherein the first channel of the swing guide is positioned generally horizontally.

7. The swing training device of claim 1 wherein the first channel corresponds to a locking portion of a desired swing path.

8. The swing training device of claim 1 wherein the second channel corresponds to a release portion of a desired swing path.

9. The swing training device of claim 1, further comprising a target object positioned generally along a desired swing path past an exit point of the second channel, wherein a user would strike the target object by passing the swing implement along the desired swing path following a disconnection of the swing implement from the second channel.

10. The swing training device of claim 1 wherein a dimension of the lateral opening of the first and second channels is less than a dimension of the first and second channels.

11. The swing training device of claim 1 wherein the mount includes an adjustable portion for varying the height of the swing guide above the ground.

12. The swing training device of claim 1 wherein the mount includes a strap for attaching the swing guide to at least one of a wall and post.

13. The swing training device of claim 1 wherein the mount includes a vertically-adjustable telescoping arm for selectively positioning the swing guide above the ground.

14. The swing training device of claim 13 wherein the mount includes a stand mounted to a lower end of the telescoping arm.

* * * * *